US009636815B2

(12) United States Patent
Doberenz et al.

(10) Patent No.: US 9,636,815 B2
(45) Date of Patent: May 2, 2017

(54) TOOL RECEPTACLE

(75) Inventors: Matthias Doberenz, Untermeitingen (DE); Andres Wellmann Jelic, Landsberg am Lech (DE)

(73) Assignee: Hilti Aktiengesellschaft, Schaan (LI)

( * ) Notice: Subject to any disclaimer, the term of this patent is extended or adjusted under 35 U.S.C. 154(b) by 1392 days.

(21) Appl. No.: 13/402,635

(22) Filed: Feb. 22, 2012

(65) Prior Publication Data

US 2013/0056940 A1 Mar. 7, 2013

(30) Foreign Application Priority Data

Feb. 23, 2011 (DE) ..... 10 2011 004 558
Feb. 23, 2011 (DE) ..... 10 2011 004 559

(51) Int. Cl.
*B25D 17/08* (2006.01)

(52) U.S. Cl.
CPC ..... *B25D 17/08* (2013.01); *B25D 2217/0042* (2013.01); *B25D 2250/231* (2013.01); *Y10T 279/17042* (2015.01)

(58) Field of Classification Search
CPC ..... B25D 17/08; B25D 2250/231; B25D 2217/0042; Y10T 279/17042
USPC ..... 279/19–19.7, 22, 75, 82, 905, 30
See application file for complete search history.

(56) References Cited

U.S. PATENT DOCUMENTS 4,629,375 A * 12/1986 Lieser ..... B25B 23/0035 279/75
6,651,990 B2 * 11/2003 Higasi ..... B25B 23/0035 279/19.4
2003/0047888 A1 3/2003 Hahn
2008/0292419 A1 11/2008 Hild et al.

FOREIGN PATENT DOCUMENTS

| | | |
|---|---|---|
| DE | 35 06 008 A1 | 8/1986 |
| DE | 38 43 465 A1 | 6/1990 |
| DE | 602 02 724 T2 | 1/2006 |
| DE | 10 2006 016 804 A1 | 10/2007 |
| EP | 1 293 303 A1 | 3/2003 |
| GB | 2 171 340 A | 8/1986 |

OTHER PUBLICATIONS

European Search Report, dated May 10, 2012, 9 pages.
German Search Report, dated Jan. 31, 2012, 5 pages.

* cited by examiner

*Primary Examiner* — Eric A Gates
*Assistant Examiner* — Paul M Janeski
(74) *Attorney, Agent, or Firm* — Crowell & Moring LLP

(57) ABSTRACT

A tool receptacle is disclosed. The tool receptacle has a receiving sleeve which has a prismatic or cylindrical cavity for receiving a tool and an elongated hole for receiving a locking body. The elongated hole has a closed edge formed of two opposing longitudinal sides at a constant distance and two end sides completing the elongated hole. An extension along the working axis of at least one of the end sides is less than half of the constant distance of the opposing longitudinal sides. A groove running parallel to the working axis is provided on an inner surface of the receptacle sleeve. The groove is disposed in an extending manner at the elongated hole on the inner surface along the working axis.

9 Claims, 3 Drawing Sheets

TOOL RECEPTACLE

This application claims the priority of German Patent Document No. 10 2011 004 558.9, filed Feb. 23, 2011, and German Patent Document No. 10 2011 004 559.7, filed Feb. 23, 2011, the disclosures of which are expressly incorporated by reference herein.

BACKGROUND AND SUMMARY OF THE INVENTION

The present invention relates to a tool receptacle, in particular for percussive power tools, e.g., bore cutting power tools, which may be guided by hand.

The tool receptacle according to an aspect of the invention has a receptacle sleeve, which has a straight prismatic or cylindrical cavity for receiving a tool and an elongated hole for receiving a locking body along a working axis. The elongated hole has a closed edge formed of two opposing longitudinal sides at a constant distance and two ends sides completing the elongated hole along the working axis. The elongated hole has its greatest dimension in one direction, referred to as the longitudinal direction. The longitudinal sides are parallel to the longitudinal direction, e.g., also parallel to the working axis, consequently at a constant distance. The other sections of the edge, which are not parallel to the longitudinal direction, belong to the end sides. The transition between the longitudinal sides and end sides is recognizable through a change in the inclination with respect to the working axis, e.g., if the longitudinal axes are parallel and therefore not inclined with respect to the working axis, the end sides, on the other hand, are inclined over their entire length to different degrees, up to perpendicular, with respect to the working axis. An extension along the working axis of at least one of the end sides is less than half of the constant distance of the opposing longitudinal sides. The at least one end side is flattened with respect to a semicircle connecting the longitudinal sides. The receptacle sleeve surprisingly proved to be more resistant to the impact stress exerted by the percussive components of the striking mechanism and the rebounding tool.

One embodiment provides that the at least one end side has a linear section in the circumferential direction around the working axis. The linear extension of the end side may be parallel to a shortest connecting line between the two longitudinal sides.

One embodiment provides that a longitudinal groove running parallel to the working axis is provided on an inner surface of the receptacle sleeve and an open end of the groove is adjacent to one of the end sides.

The at least one elongated hole interrupts the at least one longitudinal groove. The at least one end side may have a linear section, whose length corresponds to a width of the longitudinal groove.

The groove is disposed in an extending manner at the elongated hole on the inner surface along the working axis.

One embodiment provides that a groove base of the groove is perpendicular to a radial direction relating to the working axis.

One embodiment provides that the cavity having a plurality of edges running parallel to the working axis is prismatic, and each of the longitudinal grooves is disposed at an angular position corresponding to one of the edges. The longitudinal groove along the working axis may be shorter than the one of the edges. The groove widens the edge locally in the circumferential direction.

The following description explains the invention on the basis of exemplary embodiments and figures.

DETAILED DESCRIPTION OF THE DRAWINGS

Unless otherwise indicated, the same or functionally equivalent elements are indicated by the same reference numbers in the figures.

Figure 1:
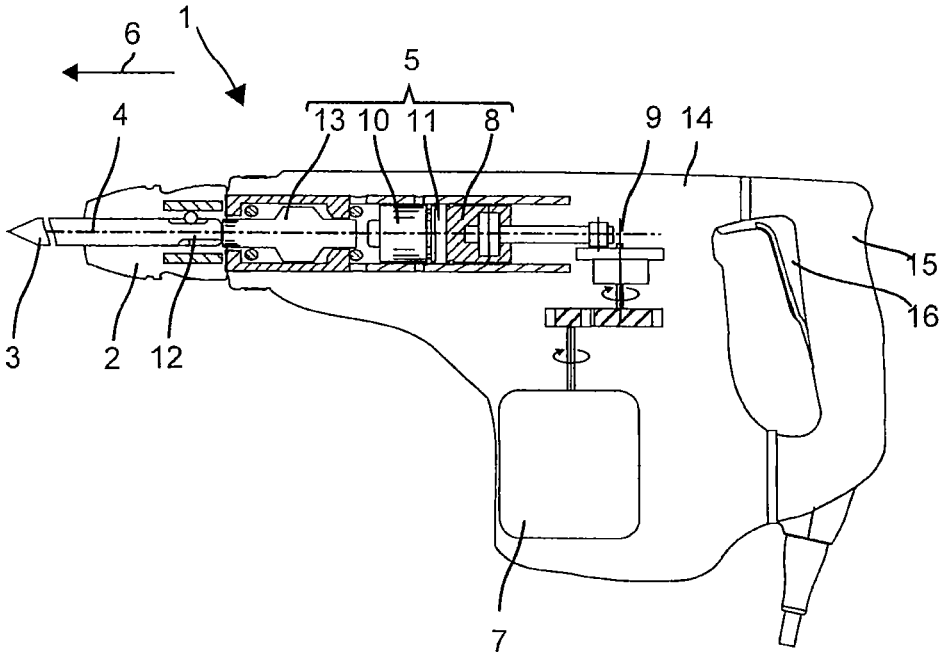
FIG. 1 illustrates a chipping hammer.

FIG. 1 schematically shows a chipping hammer 1 as an example of a chiseling handheld power tool. The chipping hammer 1 has a tool receptacle 2, which accommodates a chisel 3 and is positioned in a guided manner along a working axis 4. A striking mechanism 5 drives the chisel 3 along the working axis 4 in the impact direction 6 into a substrate or a workpiece. The striking mechanism 5 is driven by a motor 7, e.g., an electric motor. An exemplary pneumatic striking mechanism 5 has an exciter 8, which is moved by an eccentric 9 driven by the motor 7 back and forth periodically along the working axis 4. A striking device 10 is coupled to the exciter 8 via a pneumatic chamber 11 and follows its movement in a delayed manner. In the impact direction 6, the striking device 10 directly impacts a shaft end 12 of the chisel 3 or indirectly impacts the shaft end 12 via an intermediate striking device 13. The striking mechanism 5 is disposed in a machine housing 14. An operator may guide the chipping hammer 1 by means of one or two hand grips 15, which are connected to the machine housing 14 rigidly or in a damped manner. An operator may put the chipping hammer 1 into operation by actuating a main switch 16.

Figure 2:
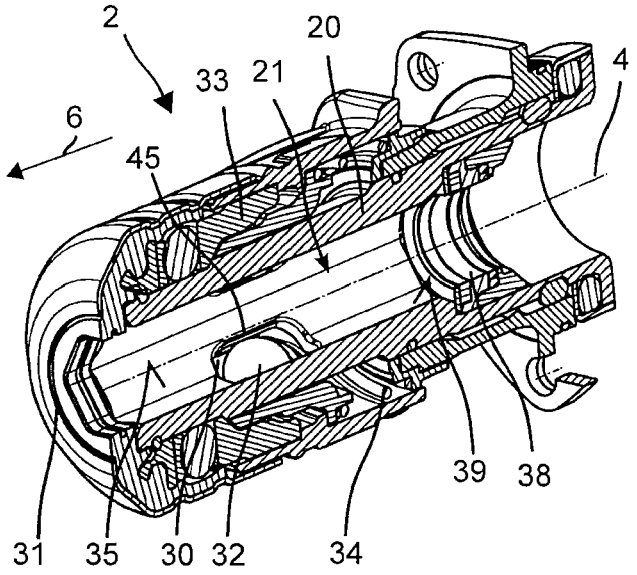
FIG. 2 illustrates a tool receptacle.

FIG. 2 shows details of the tool receptacle 2 in a full section view. The exemplarily depicted tool receptacle 2 is designed for receiving the chisel 3 or other tools with a prismatic shaft end 12. A receptacle sleeve 20 has a cavity 21, into which the shaft end 12 may be inserted along the working axis 4. Three elongated holes 30 break through a radial wall 31 of the receptacle sleeve 20. A sphere 32 or a locking element with a different design is inserted into each of the elongated holes 30 from the radial outside. The spheres 32 project partially into the cavity 21 and may engage in a locking groove of an inserted shaft end 12 and secure the shaft end in the tool receptacle 2 from falling out. A locking sleeve 33 surrounds the spheres 32 in the radial direction and blocks them from disengaging from the cavity 21. The locking sleeve 33 may be moved against a restoring force of a spring 34, thereby opening a free space adjacent to the spheres 32, into which the spheres 32 may move to disengage from the cavity 21.

Figure 3:
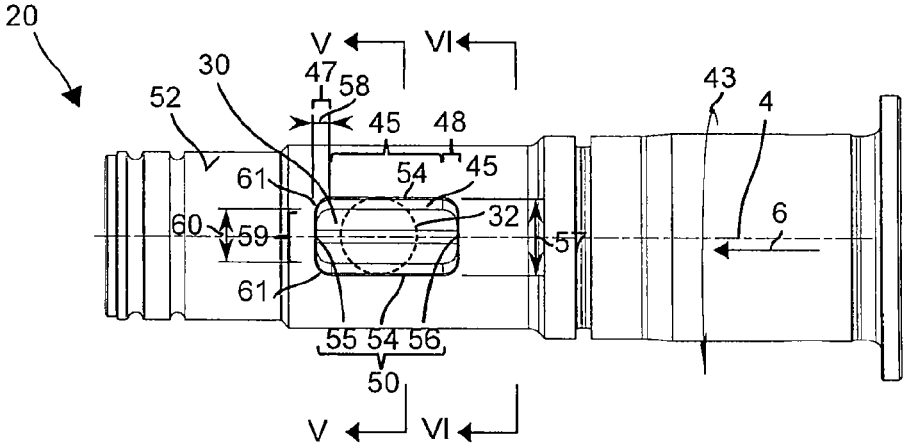
FIG. 3 to FIG. 6 illustrate a receptacle sleeve.
Figure 4:
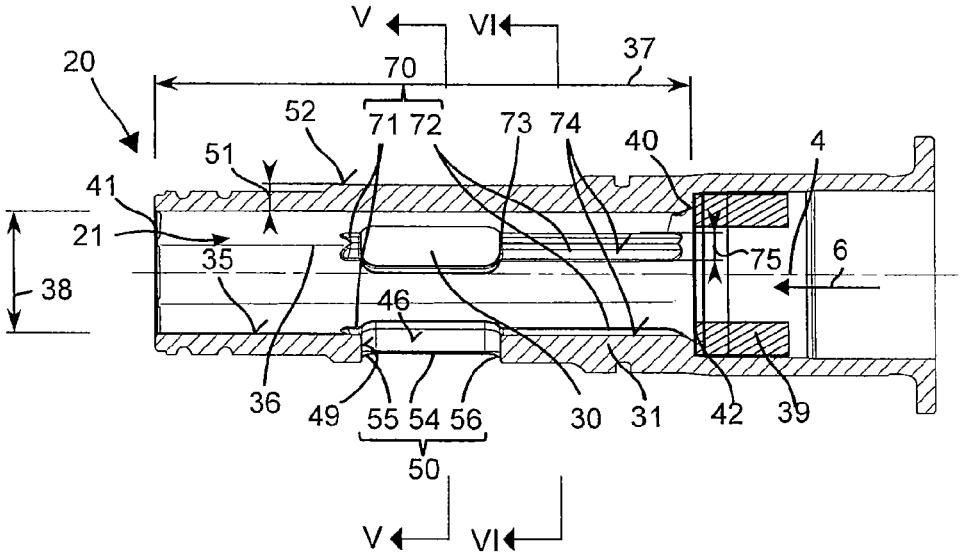
Figure 5:
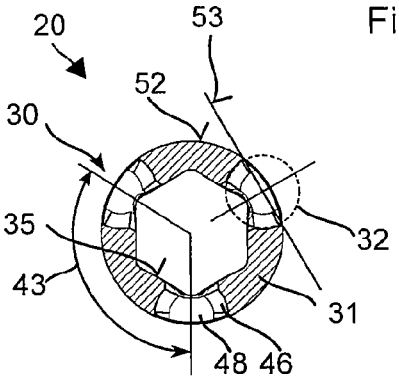
Figure 6:
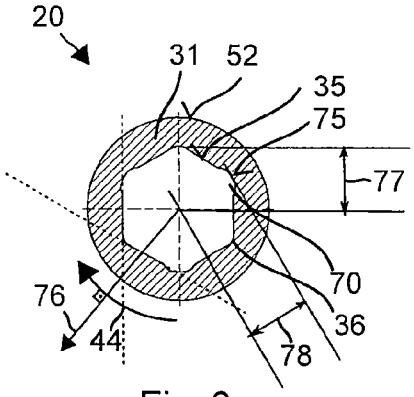

A receptacle sleeve 20 of the tool receptacle 2 is shown in a lateral view in FIG. 3, in a longitudinal section in FIG. 4 and two cross-sections in Plane V-V in FIG. 5 and in Plane VI-VI in FIG. 6.

The receptacle sleeve 20 has inner surfaces 35 parallel to the working axis 4, which delimit the prismatic cavity 21. A cross-section of the cavity 21 is reproduced in a manner similar to the cross-section of the receiving shaft end 12 of the chisel 3. In the depicted example, the cavity 21 has a regular hexagonal cross-section. The exemplary six flat inner surfaces 35 are adjacent to the chisel 3 and secure the chisel 3 against a rotation around the working axis 4. A slight play between the shaft end 12 and the inner surfaces 35 facilitates a movement of the shaft end 12 guided along the working axis 4 in the receptacle sleeve 20 of the tool receptacle 2. The prismatic cavity 21 has edges 36 that are parallel to the working axis 4 and which may be rounded. A length 37 of the cavity 21 along the working axis 4 is preferably at least three times greater than a diameter 38 of the cavity 21.

The cavity may also have a circular cross-section instead of a hexagonal cross-section for receiving cylindrical shaft ends. The receptacle sleeve in this case may have pins or bars projecting into the cavity, which prevent a rotation of the shaft end in the tool receptacle. Precisely one or two elongated holes may also be provided.

A guide 39 for the intermediate striking device 13 may be attached to the prismatic cavity 21 along the working axis 4. The guide 39 expediently has a smaller diameter than the prismatic cavity 21 and is able to form a stop face 40 against the impact direction 6 for the shaft end 12.

The receptacle sleeve 20 is broken through by one or more elongated holes 30; three in the depicted example. The elongated holes 30 open the cavity 21 in the radial direction, perpendicular to the working axis 4. The elongated holes 30 are disposed along the working axis 4 spaced apart from a front face side 41 and a rear face side 42 of the cavity 21 and are therefore closed along the working axis 4 in both in directions. A distance to the front face side 41 and the rear face side 42 is greater than 50% of the length 37 of the cavity 21. The three elongated holes 30 may be disposed at different angular positions around the working axis 4; in the depicted example, the elongated holes 30 are provided rotated by an equidistant angle 43 around the working axis 4. The elongated holes 30 are preferably disposed at the same height along the working axis 4. In the case of the exemplarily depicted prismatic cavity 21, the elongated holes 30 are disposed along the edges 36 of the cavity 21. Each of the elongated holes 30 is preferably disposed at an angular position corresponding to an edge 36 so that the elongated holes 30 interrupt the respective edges 36.

All elongated holes 30 are preferably configured to be the same, which is why only one elongated hole 30 is described exemplarily in the following. The elongated hole 30 has a greater dimension along the working axis 4 than along the surface of the receptacle sleeve 20 in the circumferential direction 44 around the working axis 4; the difference lies, for example, in the range of 0.5 cm to 3 cm. The dimension in the circumferential direction 44 corresponds essentially to a diameter of the spheres 32 in order to guide the spheres while the greater dimension along the working axis 4 of the spheres 32 facilitates a movement along the working axis 4. The elongated hole 30 has a center section 45, which guides the locking body, e.g., the spheres 32, during a movement along the working axis 4. Side surfaces 46 of the center section 45 may be segments of a cylinder jacket, which are aligned parallel to a movement path of the spheres 32, e.g., parallel to the working axis 4. The elongated hole 30 is completed in the impact direction 6 by a front end piece 47 and against the impact direction 6 by a rear end piece 48. The front end piece 47 may have a flat surface 49 perpendicular to the working axis 4. The sphere 32 may rest against this surface 49 only in a punctiform manner.

The following consideration of the geometry of the elongated hole 30 is limited to the edge 50 thereof while disregarding a depth of the elongated hole 30 or a wall thickness 51 of the receptacle sleeve 20. The edge 50 is the shape of the elongated hole 30 at a radial outer surface 52 of the receptacle sleeve 20. For a further description of the edge 50, a sectional plane 53 may be drawn through the receptacle sleeve 20, which is perpendicular to a radial direction 52 of the receptacle sleeve 20. The sectional plane 53 is placed through the outermost points in the circumferential direction 44 in order to represent the maximum dimension in the circumferential direction 44. The points of the locking body, e.g., of the spheres 32, which project the furthest in the sectional plane 53 lie preferably along the working axis 4. An almost analogous description of the edge 50 uses a projection of the elongated hole 30 onto a cylindrical projection surface, which is disposed concentrically to the working axis 4.

The closed edge 50 of the elongated hole 30 is made up completely of two longitudinal sides 54, a front end side 55 and a rear end side 56. The longitudinal sides 54 are the sections of the edge 50, which are disposed at a constant distance 57 from each other in the circumferential direction 44. The opposing longitudinal sides 54 are equidistant from one another in every section perpendicular to the working axis 4. Areas of the edge 50, which are disposed in a section perpendicular to the working axis 4 at another distance from one another, in particular at a lower distance, are allocated to the front end side 55 or to the rear end side 56. The longitudinal sides 54 may be parts of the cylindrical segments of the center section 45. In the present depicted embodiment, the longitudinal sides 54 are oriented linear and parallel to the working axis 4. The longitudinal sides 54 delimit the elongated hole 30 essentially in the circumferential direction 44. The longitudinal sides 54 serve to guide the spheres 32 along the working axis 4.

The front end side 55 touches the two front ends of the longitudinal sides 54 pointing in the impact direction 6, and the rear end side 56 touches the two rear ends of the longitudinal sides 54 pointing against the impact direction 6. The end sides 56 essentially complete the elongated hole 30 along the working axis 4. The end sides 56 do not have a semicircular shape. The sphere 32 adjacent to the end side 55 touches only a center of the end side 55. The end sides 56 are compressed as compared to a semicircular end of the elongated hole 30 connecting the longitudinal sides 54 along the working axis 4. A dimension 58 of the end sides 55 along the working axis 4 is less than half the distance 57 between the longitudinal sides 54. The exemplary end side 55 has a linear section 59 along the circumferential direction 44. The linear section 59 connects the two opposing longitudinal sides 54 in the shortest manner. The length 60 of the linear section 59 may correspond to at least 60%, e.g., to at least 80%, of the distance 57 between the longitudinal sides 54. Curved sections 61 of the end side 55 connect up the linear section 59 on the longitudinal sides 54.

Longitudinal grooves 70, which are disposed in the same angular positions around the working axis 4 as the elongated holes 30 and run parallel to the working axis 4, may be provided on the inner surfaces 35 of the receptacle sleeve 20. Each of the longitudinal grooves 70 is disposed at an angular position corresponding to an edge 36. The number of longitudinal grooves 70 coincides with the number of elongated holes 30, which may be greater than the number of edges 36 of the prismatic cavity. The longitudinal groove 70 may project beyond the elongated hole 30 along the working axis 4 in both directions. The longitudinal grooves 70 run through the elongated holes 30, and are therefore interrupted by the elongated holes 30. A front end 71 of the longitudinal groove 70 pointing in the impact direction 6 is offset from the front end side 55 of the elongated hole 30 in the impact direction 6, and a rear end 72 of the longitudinal groove 70 pointing in the direction opposite from the impact direction 6 is offset from the rear end side 56 of the elongated hole 30 in the direction opposite from the impact direction 6. The longitudinal groove 70 runs through the two end sides 55, 56. The rear end 72 extends preferably from the rear face side 42 of the cavity 21 up to the elongated hole 30. The front end 71 is preferably clearly spaced apart from the front face side 41 of the cavity 21. A distance of the front face side 41 from the front end 71 is, for example, longer than the front end 71 itself, i.e., its dimension along the working axis 4. Another embodiment provides that the longitudinal groove 70 overlaps only with an end side 55, 56. The longitudinal groove 70 therefore is made up of only a front end 71 or a rear end 72. An open side 73 of the longitudinal groove 71, 72 is adjacent to the end side 55, 56. A width 74, i.e., dimension in the circumferential direction, of the longitudinal groove 70 corresponds, for example, to the length 60 of the linear section 59 of the end sides 55, 56.

A groove base 75 of the longitudinal groove 70 is preferably flat and perpendicular to a radial direction 76. The radial direction 76 relates to the working axis 4. An angular dimension of the groove base 75 in the circumferential direction 44 is at least twice as much as an angular dimension of the rounded edge 36. The edges 36 are configured only with a convex curvature, preferably with a single radius of curvature, and merge tangentially into the neighboring flat inner surfaces 35. The edges 36 lie completely within a prism, which has linear edges instead of the rounded edges 36. The longitudinal grooves 70 intersect the prism and lie at least partially outside of the prism. A depth of the longitudinal grooves 70 is less than a wall thickness 51 of the wall 31 of the receptacle sleeve 20 and is, for example, 5% to 50% of the wall thickness 51. The depth may be selected, for example, in such a way that the groove base 75 is tangential to the edge 36. A distance 77 in the radial direction 76 of the edge 36 to the working axis 4 is equal to a distance 78 of the groove base 75 to the working axis 4.

The longitudinal grooves 70 are preferably configured by forming, e.g., extrusion, or alternatively produced by machining. The elongated holes 30 may be milled by means of a milling head in the receptacle sleeve 20 through the previously formed longitudinal grooves 70.

Figure 7:
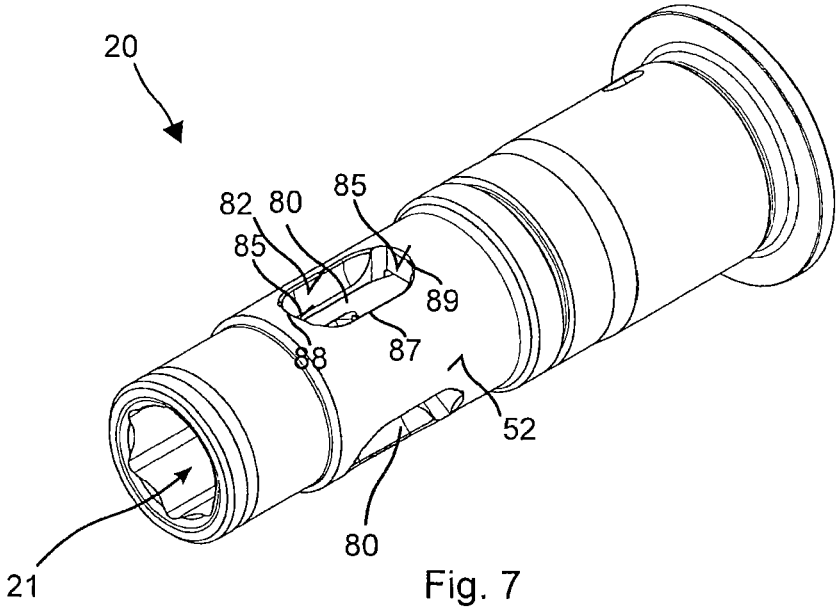
FIG. 7 to FIG. 9 illustrate another receptacle sleeve.
Figure 8:
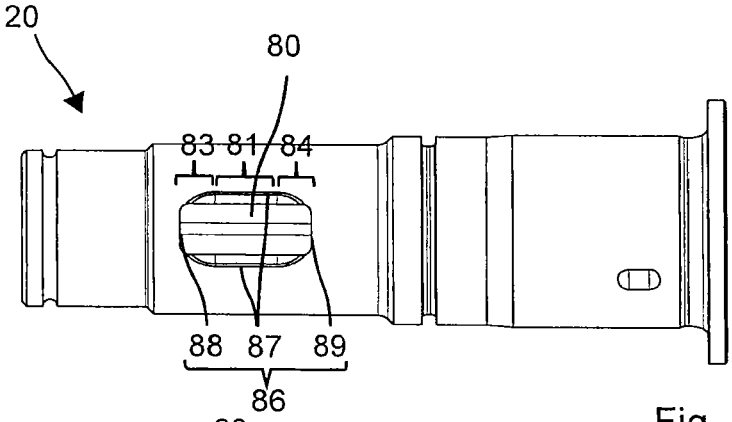

FIG. 7 and FIG. 8 show a receptacle sleeve 20 with another elongated hole 80. The elongated hole 80 has a center section 81 with surfaces 82 parallel to the working axis 4 for guiding the spheres 32. The surfaces 82 may be segments of a cylinder jacket surface. Attached to the center piece 81 is a front end piece 83 in the impact direction 6 and a rear end piece 84 against the impact direction 6. The front end piece 83 has a flat face surface 85 aligned vertically to the working axis 4. An edge 86 of the elongated hole 80 at the outer surface 52 of the receptacle sleeve 20 is made up of two opposing longitudinal sides 87 formed by the cylindrical center piece 81 and a front end side 88 and a rear end side 89. The front end side 88 is flattened at least in sections and not semicircular.

Figure 9:
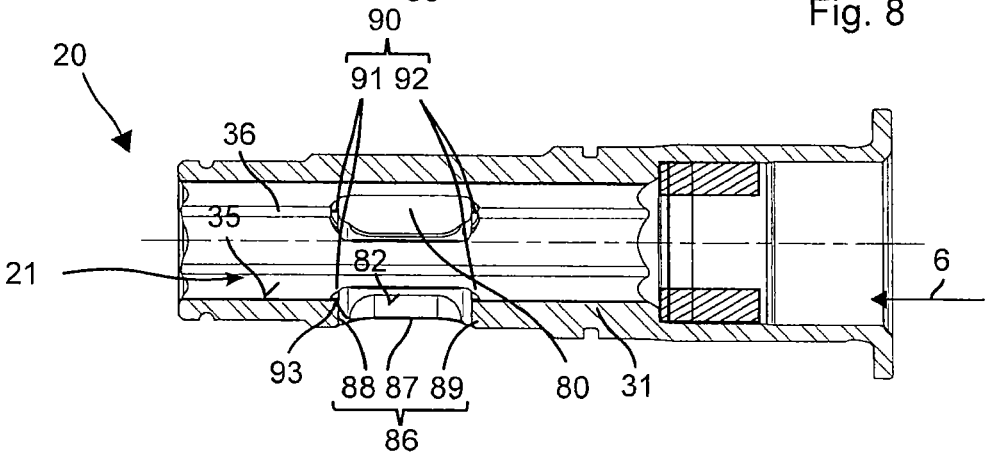

FIG. 9 depicts a partial section parallel to the working axis 4 and through the elongated hole 80. A groove 90 is introduced into the wall 31 in the axial extension to the elongated hole 80. The exemplary groove 90 has a front end 91, which projects beyond the elongated hole 80 in the impact direction 6, and a rear end 92, which projects beyond the elongated hole 80 against the impact direction 6. A groove base 93 of the groove 90 is flat and perpendicular to the radial direction 76, i.e., tangential to a cylinder that is virtually coaxial to the working axis 4.

The groove 90 runs along one of the edges 36. A depth of the groove 90, i.e., its dimension in the radial direction 76, is preferably selected in such a way that a distance of the groove base 93 from the working axis 4 is the same as a distance of the edge 36 from the working axis 4.

The groove 90 widens the rounded edge 36 in the circumferential direction 44 to a flat facet. The groove 90 is shorter along the working axis 4 than the edge 36.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A tool receptacle for a percussive power tool, comprising:

a receptacle sleeve which defines a cylindrical or prismatic cavity for receiving a tool and an elongated hole for receiving a locking body;

wherein an inner surface of the receptacle sleeve includes a groove that runs parallel to a working axis and extends beyond the elongated hole in an impact direction along the working axis, wherein a front end of the groove pointing in the impact direction is spaced apart from a front face side of the cavity.

2. The tool receptacle according to claim 1, wherein the elongated hole has a closed edge formed of two opposing longitudinal sides at a constant distance from each other and two end sides, and wherein an open side of the groove is adjacent to at least one of the end sides.

3. The tool receptacle according to claim 1, wherein a groove base of the groove is perpendicular to a radial direction relating to the working axis.

4. A tool receptacle for a percussive power tool, comprising:

a receptacle sleeve which defines a cylindrical or prismatic cavity for receiving a tool and an elongated hole for receiving a locking body;

wherein an inner surface of the receptacle sleeve includes a groove that runs parallel to a working axis and extends from the elongated hole along the working axis, wherein a front end of the groove pointing in an impact direction is spaced apart from a front face side of the cavity;

wherein the cavity has a plurality of edges running parallel to the working axis, wherein a plurality of grooves run parallel to the working axis on the inner surface of the receptacle sleeve, and wherein each of the plurality of longitudinal grooves is disposed at an angular position corresponding to one of the plurality of edges.

5. The tool receptacle according to claim 4, wherein the plurality of grooves are shorter than the plurality of edges.

6. A tool receptacle for a percussive power tool, comprising:

a receptacle sleeve which defines a cylindrical or prismatic cavity for receiving a tool and an elongated hole for receiving a locking body;

wherein an inner surface of the receptacle sleeve includes a groove that runs parallel to a working axis and extends from the elongated hole along the working axis, wherein a front end of the groove pointing in an impact direction is spaced apart from a front face side of the cavity;

wherein the groove widens in a circumferential direction.

7. A tool receptacle for a percussive power tool, comprising:

a receptacle sleeve which defines a cavity for receiving a tool, an elongated hole for receiving a locking body, and a groove that runs parallel to a working axis, wherein the groove is disposed at a same angular position around the working axis as the elongated hole, wherein a front end of the groove pointing in an impact direction is spaced apart from a front face side of the cavity, and wherein the groove extends along the working axis beyond the elongated hole in the impact direction.

8. The tool receptacle according to claim 7, wherein the groove is disposed at a same angular position around the working axis as an edge of the cavity.

9. The tool receptacle according to claim 7, wherein a front end side and a rear end side of the elongated hole are not semi-circular in shape.

* * * * *